US008301041B2

(12) United States Patent
Suzuki

(10) Patent No.: US 8,301,041 B2
(45) Date of Patent: Oct. 30, 2012

(54) POWER OFF SEQUENCE OF IMAGE FORMING APPARATUS

(75) Inventor: Toshihide Suzuki, Toride (JP)

(73) Assignee: Canon Kabushiki Kaisha (JP)

( * ) Notice: Subject to any disclaimer, the term of this patent is extended or adjusted under 35 U.S.C. 154(b) by 245 days.

(21) Appl. No.: 12/868,992

(22) Filed: Aug. 26, 2010

(65) Prior Publication Data

US 2011/0052243 A1 Mar. 3, 2011

(30) Foreign Application Priority Data

Sep. 1, 2009 (JP) ..... 2009-202102
Aug. 5, 2010 (JP) ..... 2010-176707

(51) Int. Cl.
*G03G 15/00* (2006.01)

(52) U.S. Cl. ..... 399/9; 399/18

(58) Field of Classification Search ..... 399/9, 18, 399/19, 37, 88

See application file for complete search history.

(56) References Cited

U.S. PATENT DOCUMENTS 7,590,362 B2 * 9/2009 Yamauchi et al. ..... 399/18

FOREIGN PATENT DOCUMENTS

JP 2002-354793 A 12/2002
JP 2005-267370 A 9/2005

* cited by examiner

*Primary Examiner* — Hoang Ngo
(74) *Attorney, Agent, or Firm* — Rossi, Kimms & McDowell LLP

(57) ABSTRACT

A first power source unit supplies power to a first control unit accessing a storage unit. An image forming unit controlled by a second control unit is provided with a load for forming an image. A second power source unit supplies power to the load and the storage unit. A switch unit is operated to power on or off an image forming apparatus. The first control unit, upon receiving the status signal instructing power-off, causes the storage unit to shut down and transmits an instruction to cause the load to shut down to the second control unit. The second control unit, if a shutdown instruction is not received even when the status signal instructing power-off has been detected, performs control to stop the load and then stop the supply of power from the second power source unit.

11 Claims, 6 Drawing Sheets

POWER OFF SEQUENCE OF IMAGE FORMING APPARATUS

BACKGROUND OF THE INVENTION

1. Field of the Invention

The present invention relates to a power off sequence of an image forming apparatus.

2. Description of the Related Art

A situation can occur in which, when supply of power to a hard disk is interrupted during the storage of data in a storage medium such as a hard disk, part of the data is not written into the hard disk and is thus lost. Japanese Patent Laid-Open No. 2005-267370 proposes a timer circuit for continuing to supply power for a predetermined period of time even if the user turns off the power switch. According to Japanese Patent Laid-Open No. 2005-267370, data can be protected because the supply of power continues until the hard disk drive finishes data processing.

Most image forming apparatus include two different control units (a system control unit and a printer control unit). In addition, the system control unit and the printer control unit each include a CPU. The CPU of the system control unit performs, for example, overall control of the entire image forming apparatus. The CPU of the printer control unit controls a printer engine. When the CPU of the system control unit transmits a shutdown instruction, the CPU of the printer control unit receives the shutdown instruction, and shuts down various loads controlled by the printer control unit. In the case where, for example, paper is being conveyed, the printer control unit checks the discharge of paper, and stops the power supply from the power unit. In order to safely shut down the image forming apparatus, the operator inputs a shutdown instruction through an operation unit. The shutdown instruction is generated by, for example, the operator pressing a predetermined switch provided in the operation unit, and the instruction is notified to the system control unit.

However, if an anomaly occurs in the system control unit, even when the operator issues a shutdown instruction to the system control unit, the shutdown instruction is not transmitted to the printer control unit. As a result, the printer control unit cannot perform a normal shutdown. Japanese Patent Laid-Open No. 2005-267370 does not give consideration to this issue.

SUMMARY OF THE INVENTION

A feature of the present invention is to allow an image forming apparatus to perform normal shutdown (stop power supply) even when an anomaly occurs in a control unit.

An image forming apparatus may comprise the following elements. A storage unit stores information. A first control unit accesses the storage unit and reads and writes information from and into the storage unit. A first power source unit supplies power to the first control unit. An image forming unit is provided with a load for forming an image. A second control unit controls the image forming unit. A second power source unit supplies power to the load and the storage unit. A switch unit is operated to power on or off the image forming apparatus. The switch unit transmits a status signal instructing power-on or power-off to the first control unit and the second control unit. The first control unit, upon receiving the status signal instructing power-off, performs a process to shut down operation of the storage unit and transmits an instruction to shut down an operation of the load to the second control unit. The second control unit, if a shutdown instruction from the first control unit is not received even when the status signal instructing power-off has been detected, performs control to stop the operation of the load and then stop the supply of power from the second power source unit.

Further features of the present invention will become apparent from the following description of exemplary embodiments with reference to the attached drawings.

DESCRIPTION OF THE EMBODIMENTS

An example will be described in which the present invention is applied to an image forming apparatus. The image forming apparatus may be any one of a printing apparatus, a printer, a copy machine, a multifunctional machine and a facsimile. The present invention can also be applied to other units such as an image reading unit instead of or together with an image forming unit such as a printer engine.

Figure 1:
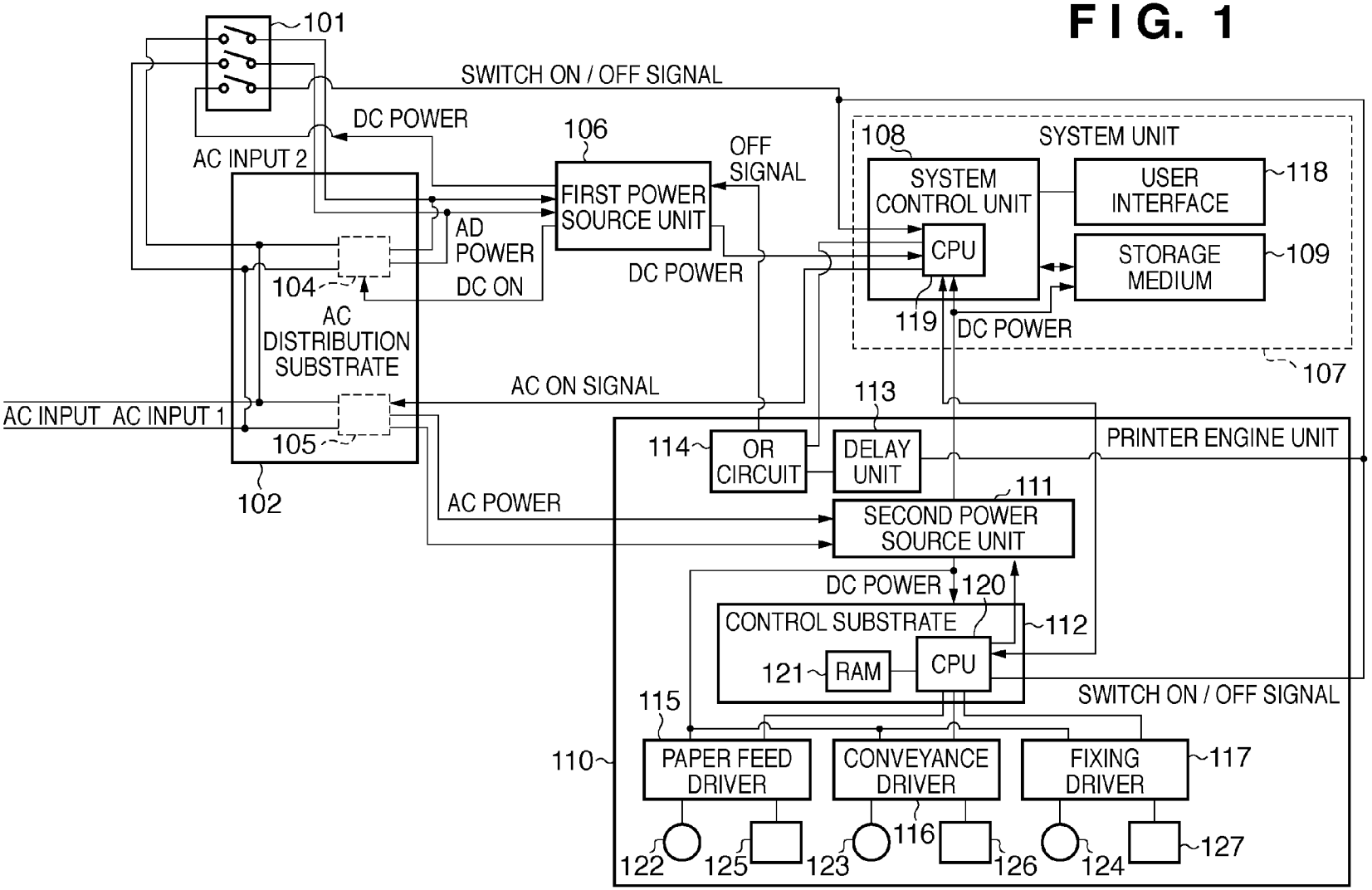
FIG. 1 is a block diagram showing control units of an image forming apparatus.

FIG. 1 is a block diagram showing control units of an image forming apparatus. The image forming apparatus can be primarily divided into a system unit 107 and a printer engine unit 110. The system unit 107 includes a system control unit 108, a storage medium 109, a user interface 118, and so on. The printer engine unit 110 is an example of an image forming unit that includes a plurality of loads for forming images. Specifically, the printer engine unit 110 includes a second power source unit 111, an engine control substrate 112, a paper feed driver 115, a conveyance driver 116, a fixing driver 117, and so on. The paper feed driver 115 is connected to a motor 122 for feeding sheets and a sensor 125 that detects the paper feed state. The conveyance driver 116 is connected to a motor 123 for conveying sheets and a sensor 126 that detects the conveyance status. The fixing driver 117 is connected to a heater and a motor 124 for fixing an unfixed toner image to a sheet and a sensor 127 that detects the sheet conveyance status in a fixing unit. The engine control substrate 112 is equipped with a CPU 120 serving as a second control unit that controls the image forming unit. The second power source unit 111 functions as a second power source unit that supplies power to the plurality of loads and the storage unit.

The power from an alternating current (AC) power source such as a commercial power source is supplied to a first power source unit 106 via a main switch 101. The main switch 101 is an example of a switch unit configured to instruct the image forming apparatus to power on and off. A line that provides AC power from the AC power source via the main switch 101 is referred to as a "first power supply line". The first power supply line is cut off by the main switch 101. The first power source unit 106 is a power source unit that supplies power even when the image forming apparatus goes into a power saving mode. The first power source unit 106 generates direct current (DC) power (current and voltage) for driving the system control unit 108. A CPU 119 of the system control unit 108 initializes itself upon receiving an input of DC power and starts up the image forming apparatus. The CPU 119, for example, converts image data from which an image is to be formed by the printer engine unit 110 to print data, stores the image data in the storage medium 109, and reads the image data from the storage medium 109. The CPU 119 also displays information on the user interface 118 that includes a key input apparatus, a display apparatus and so on, and processes keyed information. The storage medium 109 is a storage unit such as a hard disk drive or SSD (solid state drive). The CPU 119 is an example of a first control unit that accesses the storage unit and reads and writes information from and into the storage unit. The first power source unit 106 outputs a DC-on signal (first power supply instruction signal) to a relay 104. The DC-on signal is a direct current signal.

The AC power from the AC power source is input to the relay 104 without passing through the main switch 101. When the first power source unit 106 to which power is supplied through the first power supply line outputs DC power (a DC-on signal), the relay 104 connects the AC power source and the first power source unit 106. A line that conveys power from the AC power source to the first power source unit 106 via the relay 104 is referred to as a "second power supply line". The relay 104 continues to maintain the connection between the AC power source and the first power source unit 106 as long as the DC-on signal is input from the first power source unit 106. The relay 104 is not via the main switch 101. Accordingly, even if the user switches off the main switch 101, the second power supply line is not cut off. In this manner, AC power is supplied to the first power source unit 106 via the first power supply line immediately after the image forming apparatus is powered on. When the first power source unit 106 starts supplying DC power, AC power is also supplied to the first power source unit 106 via the second power supply line. In this manner, when the first power source unit 106 starts up upon receiving supply of AC power, the first power source unit 106 starts outputting a power supply instruction signal to the relay 104, and thereby the first power source unit 106 concurrently receives supply of AC power from the relay 104 as well. In order to shut down the image forming apparatus, it is necessary to stop the supply of AC power to the first power source unit 106. To this end, it is necessary to stop the transmission of the DC-on signal so as to turn off the relay 104. Incidentally, in order to cause the first power source unit 106 to stop the transmission of the DC-on signal, the CPU 119 of the system control unit 108 or a delay unit 113, which will be described later, outputs a first power off signal. Upon receiving the first power off signal, the first power source unit 106 stops the transmission of the DC-on signal to the relay 104. In this manner, the second power supply line is cut off by the first relay unit (the relay 104) included in the second power supply line based on an instruction from the first power source unit.

As described above, the first power source unit 106 is used for control over startup of the image forming apparatus. On the other hand, the second power source unit 111 is provided in the printer engine unit 110, and supplies DC power to the loads and substrates that are involved in image forming.

An AC distribution substrate 102 is equipped with a relay 105 in addition to the relay 104. The relay 105 functions as a second relay unit configured to supply AC power to the second power source unit. The AC power from the AC power source is supplied to the relay 105 without passing through the main switch 101. A line that conveys power from the AC power source to the second power source unit 111 via the relay 105 is referred to as a "third power supply line". In order to switch on the relay 105, it is necessary for the CPU 119 of the system control unit 108 to output an AC-on signal to the relay 105. The AC-on signal (second power supply instruction signal) is generated by the system control unit 108 that starts up upon receiving supply of DC power from the first power source unit 106. Accordingly, after a DC power request is made by the system control unit 108, AC power is supplied to the second power source unit 111. Also, a second power off signal is a signal for causing the printer engine unit 110 to stop the supply of AC power to the second power source unit 111 independently of the control of the system unit 107.

The second power source unit 111 converts the input AC power to DC power. The DC power from the second power source unit 111 is supplied to the engine control substrate 112 equipped with the CPU 120 and the RAM 121, as well as to the paper feed driver 115, the conveyance driver 116 and the fixing driver 117 of the printer engine unit 110. Furthermore, the non-continuous DC power is also supplied to the system control unit 108 and the storage medium 109 of the system unit 107.

The CPU 119 of the system control unit 108 accesses the storage medium 109 and reads and writes data from and into the storage medium 109. If power is cut off during writing of data, the data might be lost or other data might be damaged. To address this, it is necessary to take measures such as employing a configuration in which the power from the second power source unit 111 is not cut off immediately even when the main switch 101 is switched off. This can be implemented by the first power source unit 106 supplying power to the storage medium 109. As already described, the supply of AC power to the first power source unit 106 is maintained by the relay 104. Accordingly, continuous DC power continues to be supplied to the system control unit 108 including the storage medium 109 as long as AC power continues to be supplied to the first power source unit 106. The AC-on signal to the relay 105 is generated and output as long as continuous DC power is supplied to the system control unit 108.

On the other hand, in order to shut down the image forming apparatus, it is necessary to cut off power supply to the first power source unit 106. To this end, it is necessary to input a first power off signal to the first power source unit 106. The first power off signal for shutdown is generated and transmitted by the CPU 119 of the system control unit 108 or the delay unit 113. When either the CPU 119 or the delay unit 113 detects an opening operation (switch-off) of the main switch 101, it generates the first power off signal. The opening operation of the main switch 101 is detected based on whether the DC power output from the first power source unit 106 is input to the CPU 119 or cut off. The DC power that has been output from the first power source unit 106 and passed through the main switch 101 functions as a status signal indicating that the main switch 101 is in an open state (off state) or in a close state (on state). In other words, a status signal indicating that the main switch 101 is in an open state is a status signal indicating an instruction to power off the image forming apparatus. Likewise, a status signal indicating that the main switch 101 is in a close state is a status signal indicating an instruction to power on the image forming apparatus. Accordingly, the CPU 119 and the CPU 120 monitor the status signal (switch on/off signal). When a termination process is instructed from the operator via the user interface 118, or when the CPU 119 detects an error, the CPU 119 generates and transmits the first power off signal.

Figure 2:
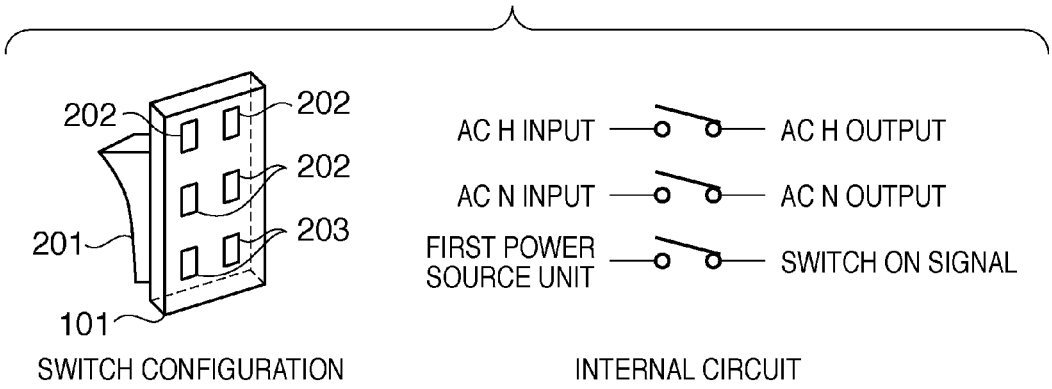
FIG. 2 is a diagram showing a structure of a seesaw switch that can be used as a main switch.
Figure 3:
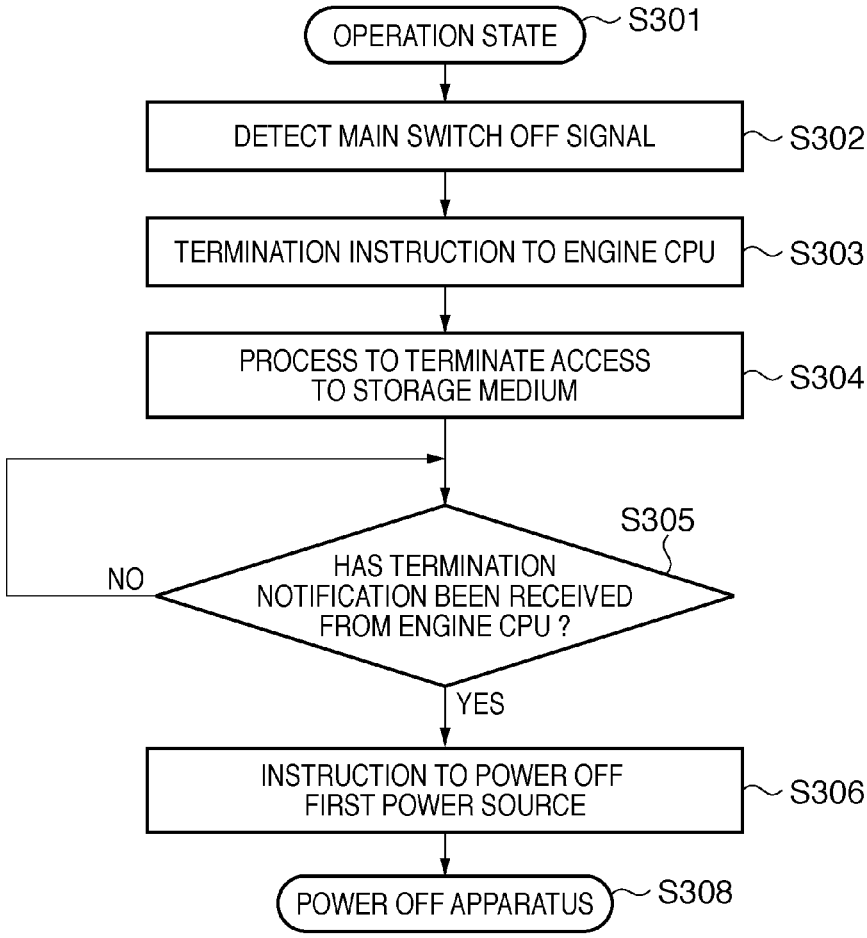
FIG. 3 is a flowchart showing the flow of an operation of a CPU of a system unit of the image forming apparatus.

An operation performed when the main switch 101 is switched to a close state by the operator will be described. As shown in FIG. 2, the main switch 101 includes four AC terminals 202 for turning on and off AC H/N and two DC terminals 203 for turning on and off the DC power of a single line. Two terminal pairs including four AC terminals 202 and one terminal pair including two DC terminals 203 are turned on and off in conjunction with the on/off operation of a seesaw unit 201. In the present embodiment, the DC power from the first power source unit 106 is input to an input-side DC terminal 203, and an output-side DC terminal 203 is connected to the CPU 119 of the system control unit 108. The CPU 119 determines that the operator has switched the main switch 101 from a close state to an open state by detecting the DC power from the output-side DC terminal 203. In other words, when the main switch 101 is switched to an open state, the CPU 119 starts a shutdown process. The shutdown process performed by the CPU 119 will be described with reference to FIG. 3.

In S301, it is assumed that the image forming apparatus is in an operation state. As used herein, the operation state refers to a state in which both the first power source unit 106 and the second power source unit 111 supply power. In a power saving state (mode), only the first power source unit 106 supplies power and the second power source unit 111 stops power supply. In the operation state, the CPU 119 of the system control unit 108 monitors a signal input from the main switch 101. The signal indicates whether the main switch 101 is on or off. A switch-on signal is high (for example, several volts), and a switch-off signal is low (for example, 0 volts).

In S302, the CPU 119 of the system control unit 108 detects whether or not the signal from the main switch 101 has been switched from an on-signal to an off-signal. If the main switch 101 is not switched to an open state, other processes are performed. If the signal from the main switch 101 is switched to an off-signal, in S303, the CPU 119 is operated to stop power supply to the CPU 120 of the printer engine unit 110 so as to prepare for the shutdown (termination) of the image forming apparatus.

In S304, the CPU 119 of the system control unit 108 performs a process to terminate access to the storage medium 109. The order in which the instruction to stop power supply and the process for terminating access to the storage medium 109 are performed may be reversed, or they may be performed concurrently. In the case where the order is reversed, the CPU 119 checks whether the process for terminating access to the storage medium 109 is finished, and when the CPU 119 confirms that the access termination process has been finished, the CPU 119 instructs the CPU 120 to stop power supply. When the process for terminating access to the storage medium 109 is finished, the system unit 107 enters a state in which normal shutdown is possible. However, when the power supply is stopped in a state in which the printer engine unit 110 cannot be shut down normally, for example, a paper jam may occur in the paper feeding unit, the conveyance unit, the image forming unit or the fixing unit, or a detrimental effect may be caused on adjustment values for image forming, and the like. The state in which such problems occur is referred to as a state in which normal shutdown is not possible. Accordingly, the power supply must be stopped after the operation state of the printer engine unit 110 is detected by the CPU 119 and the operation state goes into a state in which normal shutdown is possible. In S305, the CPU 119 of the system control unit 108 determines whether or not a termination notification has been received from the CPU 120 of the printer engine unit 110. The CPU 120, upon receiving a shutdown instruction from the CPU 119, determines whether the loads can be shut down. If the loads can be shut down, the CPU 120 provides a termination notification that is a signal indicating that the loads can be shut down to the CPU 119. The CPU 119, upon receiving the termination notification, determines that the operation state of the printer engine unit 110 has entered a state in which normal shutdown is possible, and control advances to S306.

In S306, the CPU 119 generates and outputs a first power off signal for stopping the power supply of the first power source unit 106. The first power off signal is input to the first power source unit 106 via an OR circuit 114. As just described, the CPU 119 is configured to, upon receiving a termination notification, provide an instruction to cut off the third power supply line to the second relay unit, and thereby stop the supply of AC power to the second power source unit, and transmit a first power off signal to the first power source unit. The first power source unit 106, upon receiving an input of the first power off signal, stops the output of the DC-on signal to the relay 104. This stops the supply of AC power to the first power source unit 106 via the second power supply line. As just described, the first power source unit 106 is configured to stop the supply of AC power to the first power source unit 106 by controlling the relay 104 in response to the first power off signal and cutting off the second power supply line.

Because the main switch 101 has already been switched off, the supply of AC power via the first power supply line is also stopped. In addition, because the output of the AC-on signal to the relay 105 is also stopped when the supply of AC current to the first power source unit 106 is stopped, the supply of AC current to the second power source unit 111 via the third power supply line is also stopped. Accordingly, the second power source unit 111 stops the supply of DC power. In this manner, the units of the image forming apparatus are shut down (S308).

If the CPU 119 is in a state in which it can transmit an instruction signal to stop the power supply to the CPU 120, a shutdown sequence is performed according to the following procedure. However, if the instruction signal is not transmitted to the CPU 120 for some reasons, the shutdown sequence primarily performed by the CPU 119 does not function. In other words, even if the operator switches off the main switch 101, the image forming apparatus is not shut down. The case where the instruction signal is not correctly transmitted to the CPU 120 is conceivably caused by, for example, an anomaly with the operation of the CPU 119, an anomaly with the communication lines, or the communication lines being contaminated with noise. To address this, the following protection mechanism implemented by the delay unit 113 and the OR circuit 114 is provided. The delay unit 113 and the OR circuit 114 function as an off-signal transmitting unit that transmits the first power off signal instead of the CPU 119 if the CPU 119 does not transmit the first power off signal even when the main switch 101 is turned off.

The delay unit 113 is connected to the output-side DC terminal of the pair of DC terminals 203 of the main switch 101, and receives a switch-off signal from the main switch 101 as in the case of the CPU 119. When a first predetermined time elapses after the switch-off signal is input, the delay unit 113 generates and outputs a first power off signal. The delay unit 113 can have a configuration in which the power is turned off after a first predetermined time elapses after input of the switch-off signal such as a timer circuit, or a configuration in which the power is not turned off for a first predetermined time by the discharge of a capacitor. The first predetermined time is longer than the time required to perform the process for terminating access to the storage medium 109. In other words, the first predetermined time is predetermined based on the writing time required to finish writing minimum unit of data in the storage medium 109 (including the time required to finish rewriting management data in the storage medium). The first power off signal output by the delay unit 113 is input to the first power source unit 106 via the OR circuit 114. In other words, the OR circuit 114 is configured to, upon receiving an input of a first power off signal from either the CPU 119 or the delay unit 113, output the first power off signal to the first power source unit 106. Accordingly, the OR circuit 114 functions as an off-signal transfer unit that transfers an off-signal to the first power source unit upon receiving an input of either a switch-off signal output from the first control unit or a switch-off signal output from the delay unit in response to a shutdown instruction via the switch unit.

In the case where the first power off signal output from the delay unit 113 via the OR circuit 114 is input to the first power source unit 106, there is a possibility that the CPU 119 is not operating normally. In other words, it is likely that the CPU 119 is not in a state in which it can transmit a termination instruction signal for instructing to stop power supply to the CPU 120. Incidentally, the CPU 120 of the engine control substrate 112 controls the paper transfer unit and the fixing unit via the respective drivers provided in the printer engine unit 110. The CPU 120 accesses a storage medium such as the RAM 121 and stores adjustment values and offset values involved in paper transfer and image formation in the storage medium.

Figure 4:
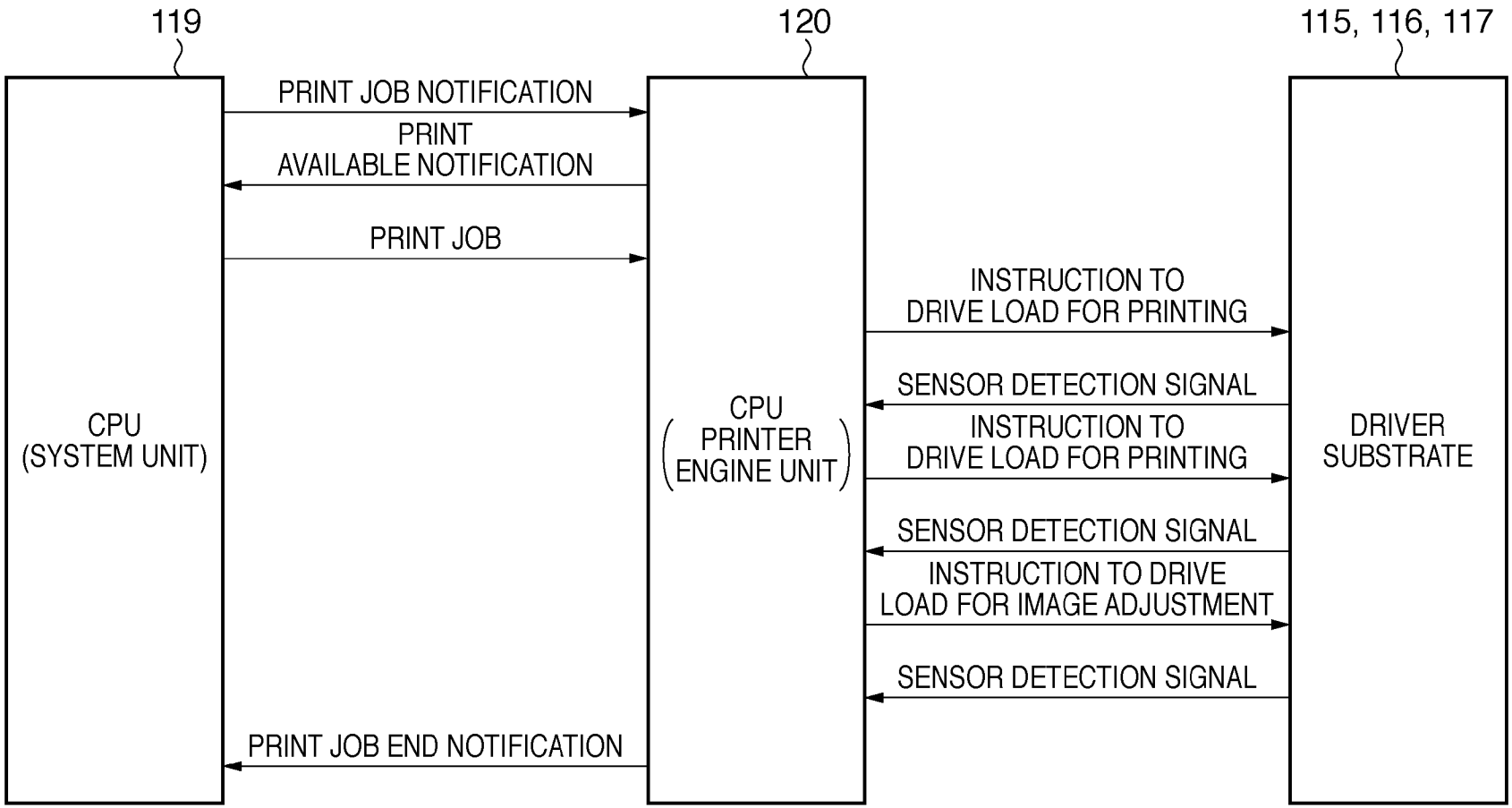
FIG. 4 is a diagram showing an example of communication between the CPU of the system unit and a CPU of a printer engine unit in the image forming apparatus.

FIG. 4 is a diagram showing an example of communication between the CPU 119, when in a normal state, of the system control unit of the image forming apparatus, the CPU 120 of the printer engine unit and the driver substrates 115 to 117. A job to form an image is transmitted to the CPU 119 of the system control unit 108 via the user interface 118 or a network. The CPU 119 transmits a print job notification indicating that it has detected a print job to the CPU 120 of the printer engine unit 110. The CPU 120, upon receiving the print job notification, determines whether the paper feed driver 115, the conveyance driver 116 and the fixing driver 117 are in a normal state. If they are in a normal state, the CPU 120 transmits a print ready notification indicating that printing is possible to the CPU 119. The CPU 119, upon receiving the print ready notification, determines that the printer engine unit 110 has entered a print ready state. After that, the CPU 119 transmits the print job to the CPU 120. The CPU 120, upon receiving the print job, controls the paper feed driver 115, the conveyance driver 116 and the fixing driver 117 to drive their loads (the motors 122, 123 and 124). Furthermore, the CPU 120 determines whether image formation has been finished properly by obtaining the detection state of the sensors 125, 126 and 127. Generally, print jobs are collectively transmitted from the CPU 119 to the CPU 120. Accordingly, when the CPU 120 receives a print job to print a plurality of copies, the CPU 120 controls all of the image forming operations. When it is necessary to perform operations after the print job, such as adjusting the image forming position of the image forming apparatus and adjusting the image density, the CPU 120 also controls all of the operations. When all of the print job is finished, the CPU 120 transmits a notification indicating that the print job is finished to the CPU 119.

Even when opening operation of the main switch 101 is performed while the CPU 119 is not operating normally, the power supply of the image forming apparatus can be cut off by the delay unit 113 and the OR circuit 114. However, the delay unit 113 and the OR circuit 114 cut off the power supply without knowing the status of the printer engine unit 110. For example, if the power supply is cut off during the conveyance of paper, the paper remains within the apparatus. If the power supply stops during the storage of image formation adjustment data in the RAM 121, there is a possibility that an anomaly might occur in the data. There is also a possibility that an error might be caused such as a temperature anomaly in the fixing unit.

In order to cut off the power supply without causing an anomaly in the printer engine unit 110 even when the CPU 119 is not operating normally, the switch-off signal from the main switch 101 is also notified to the CPU 120 of the printer engine unit. The CPU 120 thereby can independently perform a shutdown sequence even when the CPU 119 is not operating normally. Accordingly, the main switch 101 functions as a switch unit configured to instruct at least the CPU 119 and the CPU 120 to shut down the image forming apparatus through an operation by the operator.

Figure 5:
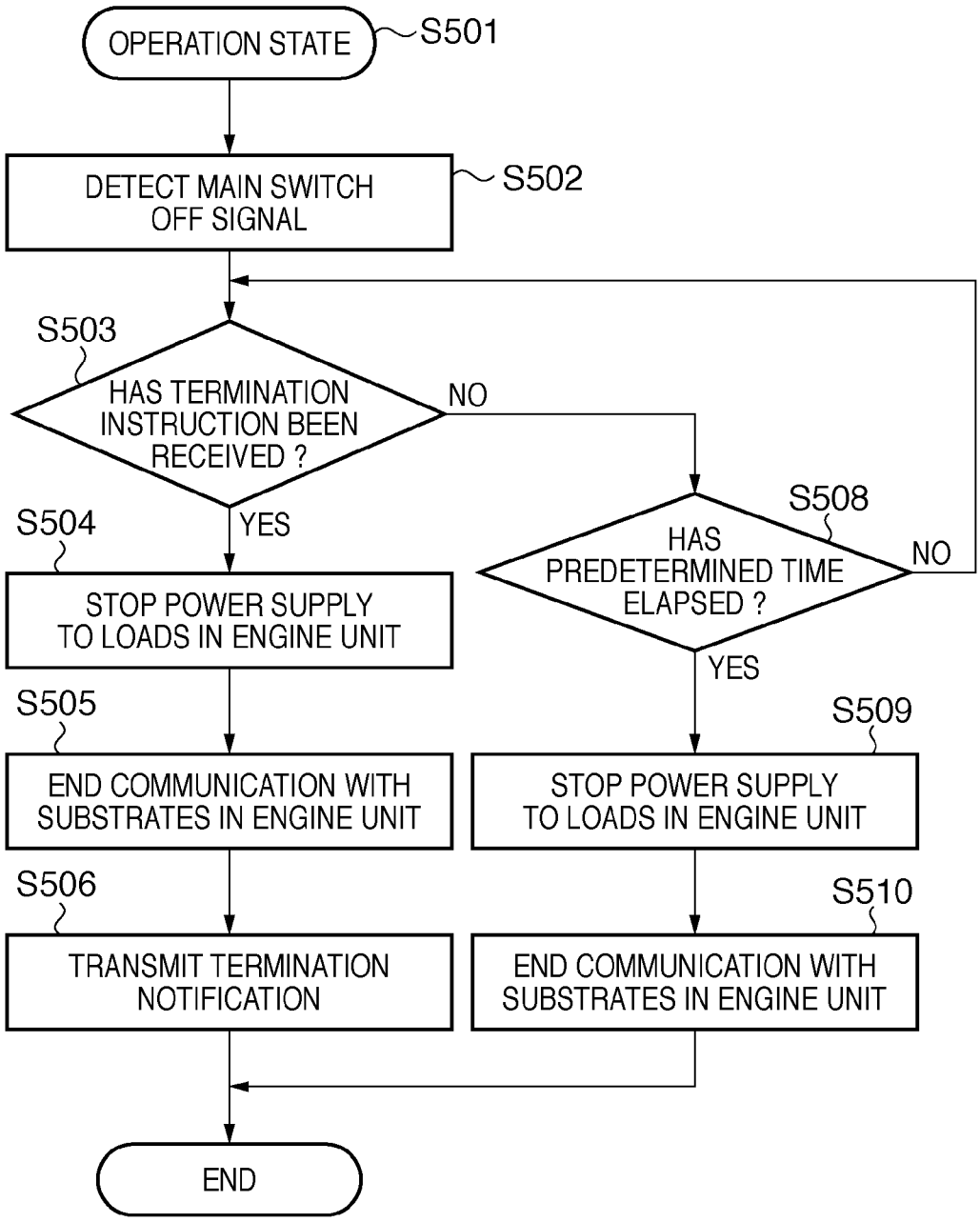
FIG. 5 is a flowchart showing the flow of an operation of the CPU of the printer engine unit.

FIG. 5 is a flowchart showing a shutdown process performed by the CPU 120 of the printer engine unit. In S501, the CPU 120 is in an operation state, and monitors a switch-off signal from the main switch 101. If there is no switch-off signal, the CPU 120 performs other processes. In S502, if the CPU 120 detects a switch-off signal, control advances to S503. In S503, the CPU 120 determines whether or not a termination instruction has been received from the CPU 119 of the system unit 107. If the termination instruction is not received, control advances to S508. In S508, the CPU 120 measures an elapsed time from the detection of the switch-off signal, and determines whether or not the elapsed time has exceeded a second predetermined time. The second predetermined time is a time predetermined to detect an operation error of the first control unit. The CPU 120 functions as a measurement unit that measures an elapsed time from the receipt of an off-signal indicating that the switch unit has been turned off. If the elapsed time has not exceeded the second predetermined time, control returns to S503. In other words, if a termination instruction is received before the second predetermined time elapses, the CPU 120 determines that the CPU 119 is operating normally, and control advances to S504. The steps from S504 to S506 constitute a shutdown sequence based on an instruction from the CPU 119. On the other hand, the steps S509 and S510 constitute a spontaneous shutdown sequence of the CPU 120 due to an anomaly in the CPU 119.

In S504, in order to shut down the loads, the CPU 120 outputs a second power off signal for stopping the power supply to the loads to the second power source unit 111. The CPU 120 may monitor the state of the loads provided in the printer engine unit 110, and detect whether or not the loads are in a normal state in which an error does not occur even if the power to the loads is stopped. Then, the CPU 120 may transmit the instruction to the second power source unit 111 after it detects that the loads can be shut down normally (normal state). Accordingly, the CPU 120 functions as an instruction unit that instructs the second power source unit to stop the supply of power to the storage unit and the loads that are in a state in which they can be shut down normally if there is no shut down instruction from the first control unit when the elapsed time has exceeded the second predetermined time.

In S505, the CPU 120 ends the communication with the driver substrates provided in the printer engine unit 110, whereby all of the functions of the printer engine unit 110 enter a shutdown available state. In S506, the CPU 120 transmits a termination notification (shutdown available notification) to the CPU 119. The printer engine unit 110 thereby enters a waiting state in which power can be cut off.

On the other hand, in S508, if a termination instruction is not received from the CPU 119 even after the second predetermined time elapses, control advance to S509. In S509, the CPU 120 detects that an anomaly has occurred in the communication with the CPU 119, and stops the power supply to the loads from the second power source unit 111 in order to shut down the loads. In S510, the CPU 120 ends the communication with the driver substrates provided in the printer engine unit 110. However, because the communication with the CPU 119 is not established, the CPU 120 does not transmit a termination notification to the CPU 119. The first predetermined time is preset such that a first power off signal is output from the delay unit 113 after completion of steps S509 and S510. In other words, the first predetermined time is set longer than the second predetermined time.

As described above, in the present embodiment, the printer engine unit 110 can also enter a state in which power can be cut off normally regardless of whether a termination instruction is given from the CPU 119 of the system unit 107. In addition, if a termination instruction is not received from the CPU 119 even after the main switch 101 is turned off, the CPU 120 determines whether the loads of the printer engine unit 110 can be shut down normally. When the loads enter a state in which they can be shut down normally, the CPU 120 outputs a second power off signal to stop the supply of AC power to the second power source unit 111.

Figure 6:
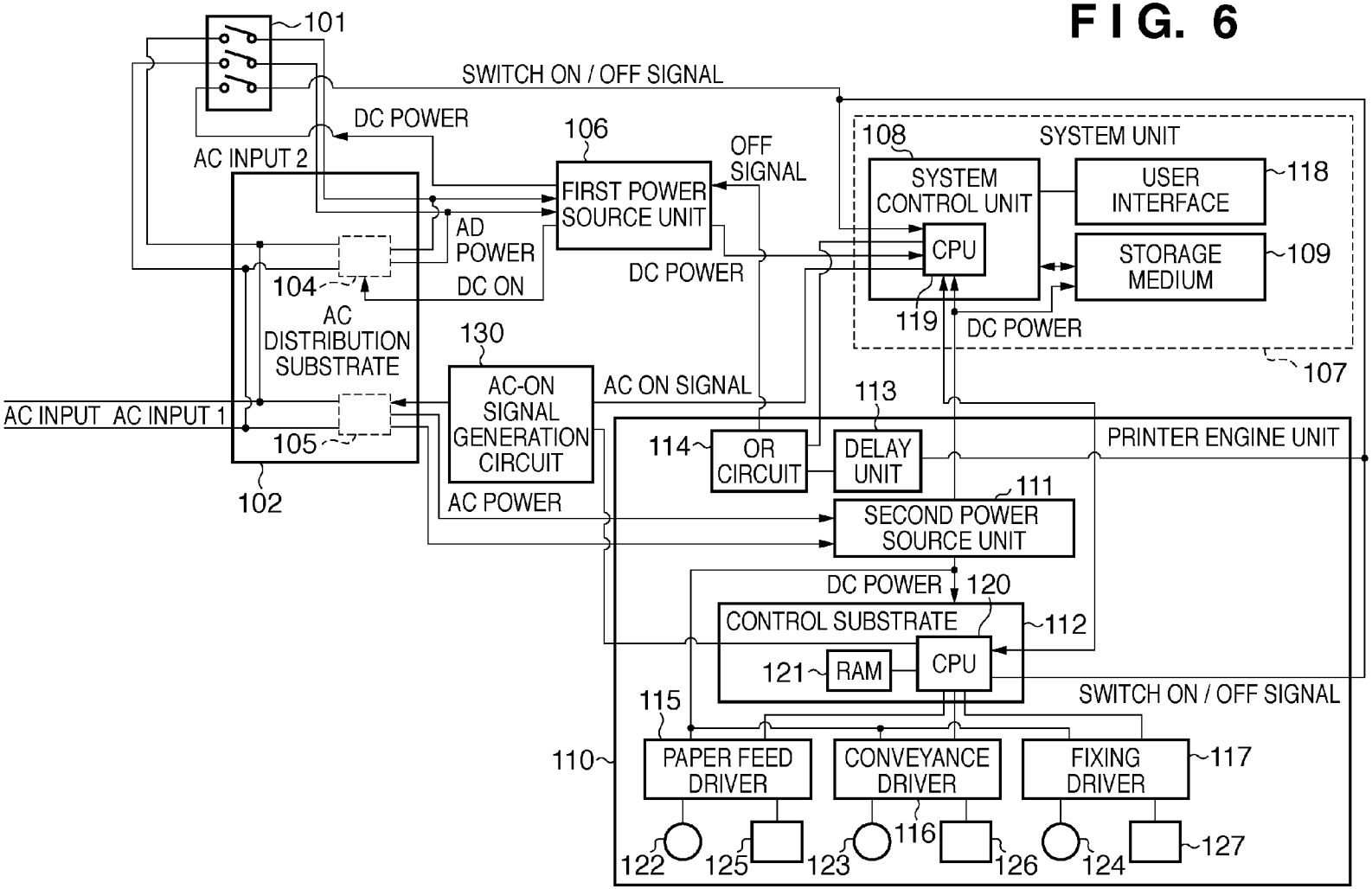
FIG. 6 is a block diagram showing another example of control units of the image forming apparatus.

It is also possible to employ a configuration as shown in FIG. 6 instead of outputting the second power off signal from the CPU 120 to the second power source unit. Specifically, the AC-on signal from the CPU 119 and the second power off signal from the CPU 120 are input to an AC-on signal generation circuit 130, and either signal is output to the relay 105.

Figure 7:
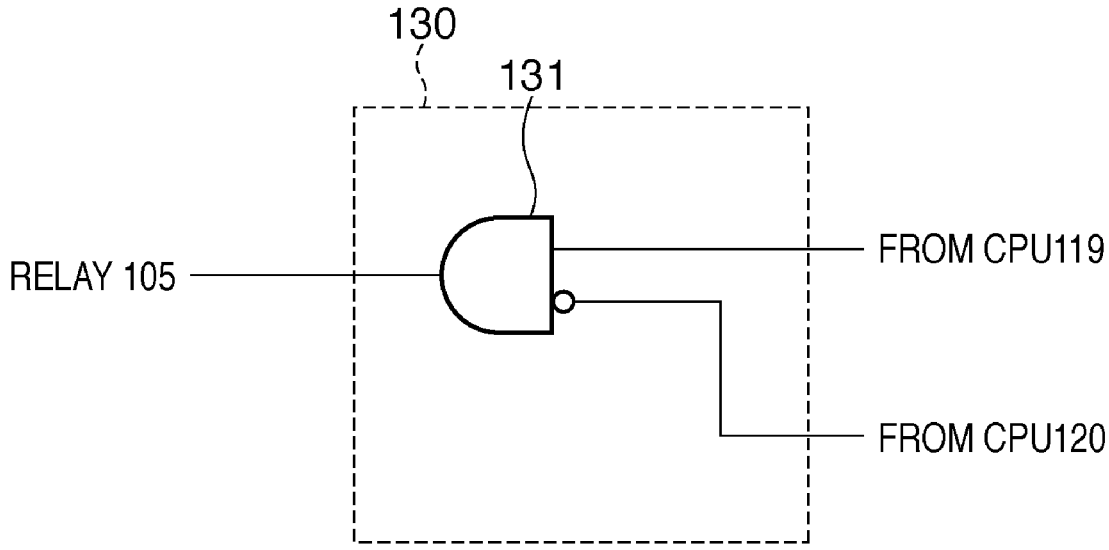
FIG. 7 is a diagram showing an example of a configuration of an AC-on signal generation circuit.

FIG. 7 shows a configuration of the AC-on signal generation circuit 130. The AC-on signal generation circuit 130 includes an AND gate 131. The AC-on signal from the CPU 119 is input to one input terminal of the AND gate 131, and the second power off signal from the CPU 120 is input to the other input terminal. When the CPU 119 causes AC power to be supplied to the second power source unit 111, a high-level AC-on signal is input to the AND gate 131. However, because power is not supplied to the engine control substrate 112 at this time, the second power off signal remains at low level. Accordingly, the high level signal (AC-on signal) is output from the AND gate 131, the relay 105 it turned on, and AC power is supplied to the second power source unit 111. On the other hand, when the CPU 120 causes the supply of AC power to the second power source unit 111 to stop, a high-level second power off signal is input to the AND gate 131 via an inverter. Accordingly, the output of the AND gate 131 is changed to a low level, the relay 105 is turned off, and the supply of AC power to the second power source unit 111 is cut off. It is also possible to output a second power off signal for instructing to stop power supply to the storage medium 109 and the loads to the second power source unit 111. In this case, the AC-on signal from the CPU 119 is input directly to the relay 105. The second power source unit 111 thereby stops the power supply. After that, when a first power off signal is output from the delay unit 113 and the OR circuit 114, and the first power source unit 106 is turned off, power is no longer supplied to the system unit 107, and therefore the AC-on signal is also stopped, the relay 105 is turned off, and the supply of AC power to the second power source unit 111 is also stopped.

In this manner, with the relatively simple configuration, it is possible to address anomalies in the CPU 119 or the communication lines. In the present embodiment, the occurrence of an anomaly in the CPU 119 or the communication is determined based on whether or not a prescribed signal has arrived within a prescribed period of time. Accordingly, it is possible to detect an anomaly with the relatively simple configuration without the need to directly check the CPU 119 or the like.

In the present embodiment, an alternating current is supplied to the first power source unit 106 concurrently through the first power supply line and the second power supply line. The first power supply line can be easily cut off by the main switch 101, but the second power supply line cannot be cut off if an anomaly occurs in the CPU 119. The present invention is effective particularly when such a power supply line is employed. When the CPU 119 is operating normally, by performing a shutdown after confirming that an error will not occur in the printer engine unit 110 even if power supply is stopped, the occurrence of an error can be prevented. The present embodiment has been described taking the printer engine unit 110 as an example, but the present invention is also applicable to other units having a CPU (for example, an image reading unit that reads images from an original).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-202102, filed on Sep. 1, 2009, and No. 2010-176707, filed on Aug. 5, 2010, which are hereby incorporated by reference herein in their entirety.

What is claimed is:

1. An image forming apparatus comprising:

a storage unit that stores information;

a first control unit that reads from the storage unit and writes information into the storage unit;

a first power source unit that supplies power to the first control unit;

an image forming unit provided with a load for forming an image;

a second control unit that controls the image forming unit;

a second power source unit that supplies power to the load and the storage unit;

a switch unit that is operated to power on or off the image forming apparatus, the switch unit transmitting a status signal instructing power-on or power-off to the first control unit and the second control unit, wherein the first control unit, upon receiving the status signal instructing power-off, performs a process to shut down operation of the storage unit and transmits a shutdown instruction to shut down an operation of the load to the second control unit, and the second control unit, even if the shutdown instruction from the first control unit is not received when the status signal instructing power-off has been detected, performs control to stop the operation of the load and then stop the supply of power from the second power source unit.

2. The image forming apparatus according to claim 1, wherein the second power source unit receives a supply of alternating current power via a relay that does not pass through the switch unit, and the second control unit outputs a signal for turning off the relay even if the shutdown instruction from the first control unit is not received when the status signal instructing power-off has been detected.

3. The image forming apparatus according to claim 1, wherein the second control unit outputs a power supply stop instruction to the second power source unit even if the shutdown instruction from the first control unit is not received when the status signal instructing power-off has been detected.

4. The image forming apparatus according to claim 1, further comprising an off-signal transmitting unit that, upon receiving the status signal instructing to power off the image forming apparatus, outputs an off-signal for stopping the supply of power from the first power source unit to the first power source unit after a first predetermined time elapses, the off-signal transmitting unit being provided separately from the first control unit and the second control unit.

5. The image forming apparatus according to claim 4, wherein the first predetermined time is longer than a writing time required to finish writing minimum unit of data in the storage unit.

6. The image forming apparatus according to claim 1, wherein the second control unit performs control to stop the supply of power from the second power source unit even if the shutdown is not instructed from the first control unit when an elapsed time from detection of the status signal instructing power-off has exceeded a second predetermined time.

7. The image forming apparatus according to claim 6, further comprising an off-signal transmitting unit that, upon receiving the status signal instructing to power off the image forming apparatus, outputs an off-signal for stopping the supply of power from the first power source unit to the first power source unit after a first predetermined time elapses, and the first predetermined time is longer than the second predetermined time, the off-signal transmitting unit being provided separately from the first control unit and the second control unit.

8. An image forming apparatus comprising:

a storage unit that stores information;

a first control unit that controls at least the storage unit;

a first power source unit that supplies power to the first control unit;

an image forming unit provided with a plurality of loads for forming an image;

a second control unit that controls the image forming unit;

a second power source unit that supplies power to the storage unit and the image forming unit;

a switch unit configured to notify the first control unit and the second control unit of a shutdown instruction to shut down the image forming apparatus through an operation by an operator;

a delay unit that outputs an off-signal after a first predetermined time elapses from receipt of the shutdown instruction by the switch unit;

an off-signal transfer unit that, upon receiving an input of either an off-signal output from the first control unit or the off-signal output from the delay unit in response to the shutdown instruction by the switch unit, transfers the off-signal to the first power source unit;

a first relay unit that switches between supplying alternating current power to the first power source unit and stopping the supply of alternating current power to the first power source unit, the first relay unit supplying alternating current power to the first power source unit when a first power supply instruction signal is input from the first power source unit, and stopping the supply of alternating current power to the first power source unit when the off-signal is input from the off-signal transfer unit to the first power source unit and thereby the first power source unit stops transmitting the first power supply instruction signal; and a second relay unit that supplies alternating current power to the second power source unit when a second power supply instruction signal is input from the first control unit, and stops the supply of alternating current power to the second power source unit when the second power supply instruction signal is no longer input from the first control unit, wherein the second control unit stops the supply of power from the second power source unit to the storage unit and the image forming unit if the second control unit receives a shutdown instruction from the first control unit after input of the shutdown instruction from the switch unit or if a second predetermined time elapses from input of the shutdown instruction from the switch unit.

9. An image forming apparatus comprising:

a first control unit that controls the image forming apparatus;

a first power source unit that supplies power to the first control unit;

an image forming unit configured to form an image;

a second control unit that controls the image forming unit based on an instruction from the first control unit;

a second power source unit that supplies power to the image forming unit;

a power switch that is operated manually, the power switch transmitting status signals indicating a state of the power switch to the first control unit and the second control unit, wherein the first control unit transmits a termination instruction to the second control unit and stops the supply of power from the first power source unit and the second power source unit after receiving a status signal indicating that the power switch has been turned off, and wherein the second control unit terminates the operation of the image forming unit upon receiving the termination instruction from the first control unit, and the second control unit stops the supply of power from the second power source unit after receiving the status signal indicating that the power switch has been turned off even if the first control unit does not stop the supply of power from the second power source unit.

10. The image forming apparatus according to claim 9, further comprising a stop signal output unit that receives the status signal from the power switch and outputs a signal for stopping the supply of power from the first power source unit after a predetermined time elapses after receiving the status signal indicating that the power switch has been turned off, and the predetermined time is longer than an elapsed time it takes for the second control unit from reception of the status signal indicating the power switch has been turned off to stop of supply of power from the second power source unit, the stop signal output unit being provided separately from the first control unit and the second control unit.

11. The image forming apparatus according to claim 9, wherein the second control unit transmits a termination signal to the first control unit after terminating the operation of the image forming unit in response to receiving the termination instruction from the first control unit, and the first control unit stops the supply of power from the first power source unit and the second power source unit after receiving the termination signal from the second control unit.

* * * * *